US010188993B1

(12) United States Patent
Knudsen

(10) Patent No.: US 10,188,993 B1
(45) Date of Patent: Jan. 29, 2019

(54) BLENDER

(71) Applicant: Herbert D. Knudsen, Ogallala, NE (US)

(72) Inventor: Herbert D. Knudsen, Ogallala, NE (US)

( * ) Notice: Subject to any disclaimer, the term of this patent is extended or adjusted under 35 U.S.C. 154(b) by 0 days.

(21) Appl. No.: 16/037,601

(22) Filed: Jul. 17, 2018

(51) Int. Cl.

| | |
|---|---|
| ***B01F 5/10*** | (2006.01) |
| ***B28C 5/08*** | (2006.01) |
| ***B28C 9/00*** | (2006.01) |
| ***B01F 13/02*** | (2006.01) |
| ***B01F 3/18*** | (2006.01) |

(52) U.S. Cl.
CPC ..... *B01F 3/182* (2013.01); *B01F 5/10* (2013.01); *B01F 13/0272* (2013.01); *B28C 5/0818* (2013.01); *B28C 9/004* (2013.01)

(58) Field of Classification Search
CPC ..... B05B 7/1436; B01F 3/1271; B01F 5/043; B01F 5/248; B01F 5/106; B01F 3/12; B01F 2003/125; B01F 15/0258; B01F 15/0238; B01F 3/182; B01F 13/02; B01F 13/0272; B01F 5/10; A01M 7/0092; B28C 5/0818; B28C 9/004
USPC ..... 366/139
See application file for complete search history.

(56) References Cited

U.S. PATENT DOCUMENTS

| | | | | |
|---|---|---|---|---|
| 3,334,868 | A * | 8/1967 | Lage | B01F 3/04468 366/101 |
| 4,002,325 | A * | 1/1977 | Herfeld | B01F 13/0244 34/586 |
| 4,491,419 | A * | 1/1985 | Ahrens | B01F 13/0288 366/101 |
| 7,731,411 | B2 * | 6/2010 | Pessin | B01F 3/18 366/106 |
| 8,834,011 | B2 * | 9/2014 | Dietrich | B01F 3/18 366/139 |
| 2006/0220266 | A1 * | 10/2006 | Pessin | B01F 3/18 261/23.1 |
| 2008/0037364 | A1 * | 2/2008 | Dietrich | B01F 3/18 366/148 |
| 2017/0333928 | A1 * | 11/2017 | Chapron | B01F 5/043 |

FOREIGN PATENT DOCUMENTS

| | | | | |
|---|---|---|---|---|
| SU | 1510912 | A1 * | 9/1989 | B01F 13/02 |

* cited by examiner

*Primary Examiner* — Charles Cooley
(74) *Attorney, Agent, or Firm* — Dennis L. Thomte; Thomte Patent Law Office LLC

(57) ABSTRACT

An ingredient blending apparatus is disclosed which blends a plurality of ingredients into a homogeneous blend. The apparatus includes a container which receives various ingredients in a prescribed amount. A vacuum motor has its intake side in communication with the interior of the container to suck the ingredients from the container and blow the same into a blending chamber. The ingredients blown into the blending chamber are mixed and recycled into the vacuum motor and the blending chamber until the ingredients are properly mixed or blended. When the ingredients are properly mixed or blended, they may be sent to an ingredient collection apparatus.

6 Claims, 11 Drawing Sheets

BLENDER

BACKGROUND OF THE INVENTION

Field of the Invention

This invention relates to a blender and more particularly relates to a blender for blending different materials or ingredients together such as straight milkweed floss fiber with torturous-shaped fiber such as goose down, microrollo and pica.

Description of the Related Art

It has been discovered that a blend or mixture of milkweed floss fiber and torturous-shaped fiber such as goose down, microrollo and pico results in a blend which has many uses. The problem with such a blend is that heretofore it was extremely difficult, if not impossible, to blend the mixture into a homogeneous blend for use in products such as pillows, etc.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A blender is described for blending or mixing a plurality of different materials or ingredients (hereinafter "ingredients"). The blender includes a weighing scale which has an ingredient container positioned thereon with the container being configured to contain a plurality of different ingredients therein in prescribed amounts. The ingredient container has a lower end, an upper end, and an interior compartment with the ingredient container including a selectively closeable cover at the upper end thereof.

The blender also includes a vertically disposed and elongated first tubular member having a lower end and an upper end with the lower end of the first tubular member being positioned in the interior compartment of the ingredient container so as to be communication with the ingredients therein. The first tubular member extends upwardly from the ingredient container and has a first valve positioned therein above the ingredient container. The first valve is selectively movable between open and closed positions. The first valve, when in the closed position, prevents the passage of ingredients therethrough. The first valve, when in its open position, permits the passage of ingredients therethrough. The blender further includes an elongated second tubular member having a first end and a second end. The first end of the second tubular member is in communication with the upper end of the first tubular member. The second tubular member extends laterally from the upper end of the first tubular member. A vacuum motor or machine is provided which has an intake side and a discharge side. The second end of the second tubular member is in communication with the intake side of the vacuum motor.

The blender further includes a vertically disposed and hollow blending cylinder having a closed upper end, a closed lower end, a side wall, and an internal compartment or blending chamber. The blender also includes an elongated third tubular member having a lower end and an upper end with the third tubular member extending downwardly through the closed upper end of the cylinder whereby the lower end of the third tubular member is positioned above the lower end of the cylinder and so that the upper end of the third tubular member is positioned above the closed upper end of the cylinder. The upper end of the third tubular member is in communication with the discharge side of the vacuum motor.

The closed upper end of the cylinder has an opening formed therein. The blender includes a fourth tubular member having a lower end and an upper end with the lower end of the fourth tubular member being in communication with the opening in the closed upper end of the cylinder. The blender further includes a fifth tubular member having a first end and a second end with the first end of the fifth tubular member being in communication with the upper end of the fourth tubular member. The second end of the fifth tubular member is in communication with the intake side of the vacuum motor. A sixth tubular member is also provided which has a first end and a second end. The first end of the sixth tubular member is in communication with the blending chamber of the cylinder. The second end of the sixth tubular member is in communication with a bag filling apparatus or an ingredient collection apparatus. A selectively closeable second valve is imposed in the sixth tubular member outwardly of the cylinder.

In the preferred embodiment, the first end of the sixth tubular member is in communication with the blending chamber of the cylinder at the lower end thereof. In the preferred embodiment, a deflector is provided at the lower end of the third tubular member with the deflector being configured to deflect air and ingredients passing therethrough towards the interior side wall of the container.

In operation, the ingredients to be blended are placed in the open container in prescribed amounts by weight. The cover of the container is then closed. The first valve or shut gate will then be opened. At that time, the vacuum motor is energized which creates a vacuum in the container so that the ingredients therein are sucked up through the first tubular member, through the second tubular member and into the intake side of the vacuum motor. When all the ingredients in the container have been sucked therefrom, the first valve is closed. The vacuum motor discharges the materials sucked thereinto downwardly through the third tubular member into the blending chamber of the cylinder. The deflector deflects the ingredients and air laterally outwardly to the interior side wall of the cylinder. The mix is blended together by rising the air and ingredients towards the top inside of the cylinder to be recycled through the opening formed in the upper end of the cylinder which feeds the ingredients and air to the intake side of the vacuum motor. The ingredients and air are then discharged downwardly from the vacuum motor into the container by way of the third tubular member. This procedure is repeated and continued until good mixing is achieved. When good mixing has been achieved, the mix or blend is fed to a bagging unit wherein the mix or blend is bagged.

A principal object of the invention is to provide an improved blender for blending a plurality of different materials or ingredients.

A further object of the invention is to provide an improved blender for blending straight milkweed floss fibers and torturous-shaped fiber such as goose down, microrollo and pico which results in a homogeneous blend.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
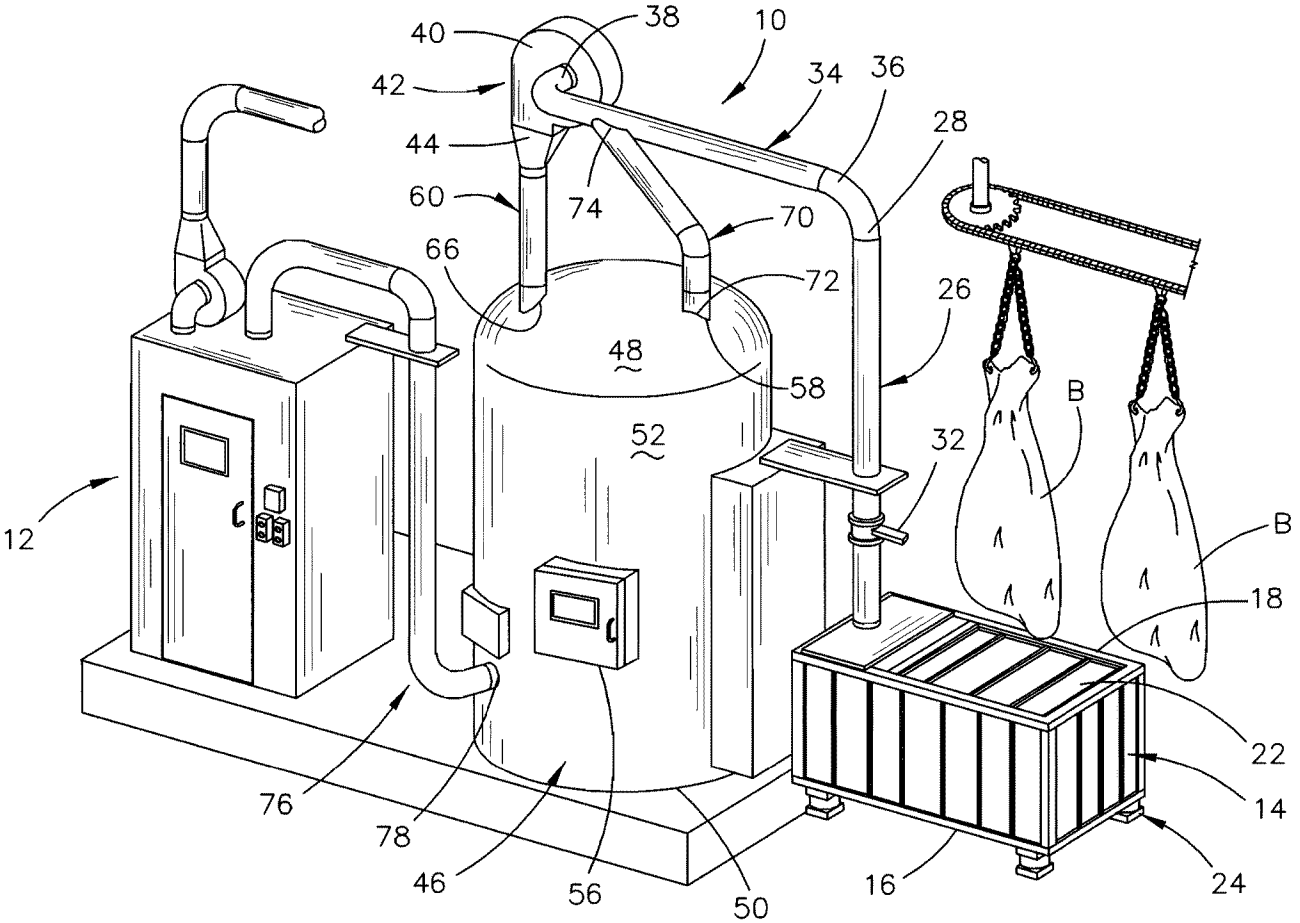
FIG. 1 is a perspective view of the blender of the invention and which illustrates a bagging unit in association therewith.
Figure 2:
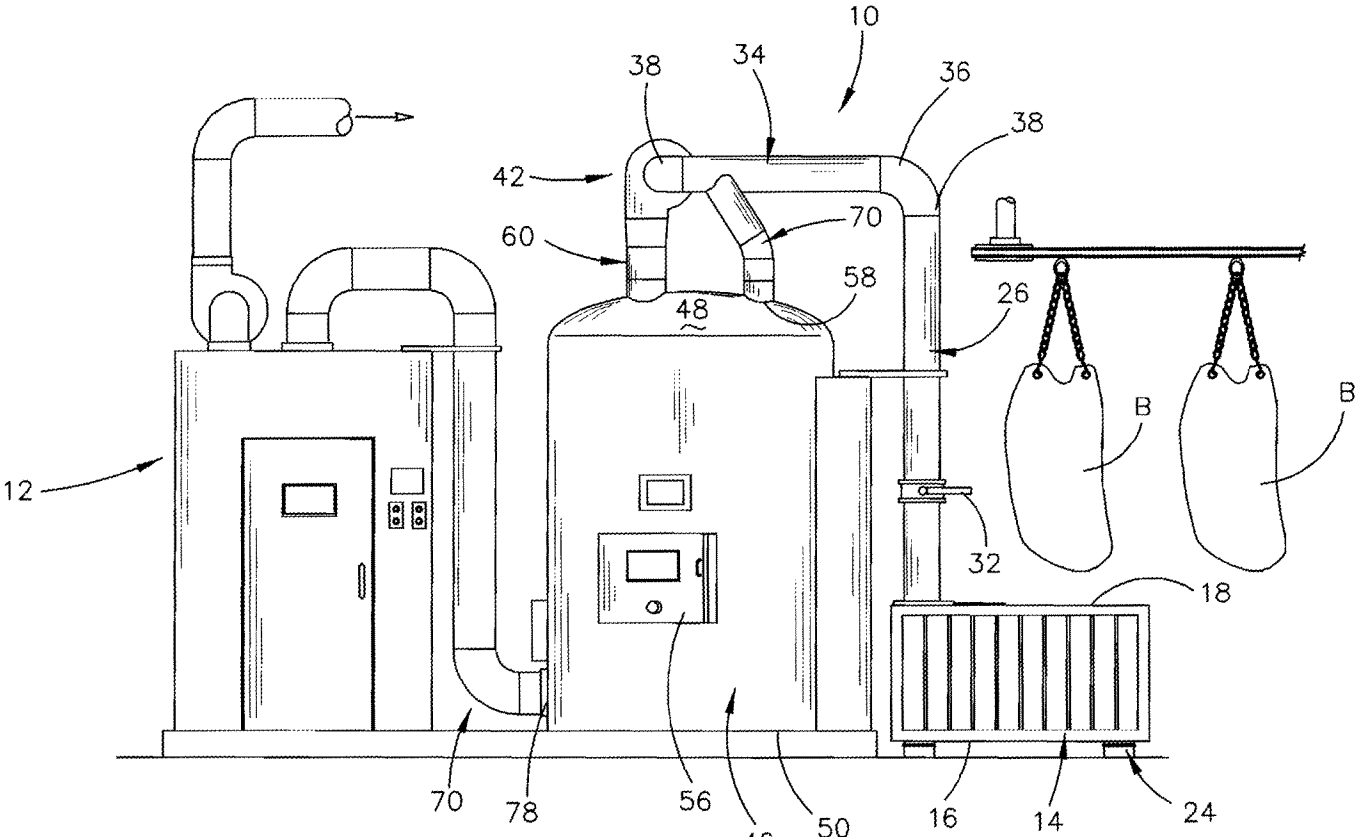
FIG. 2 is a partial side view of the blender of FIG. 1.
Figure 3:
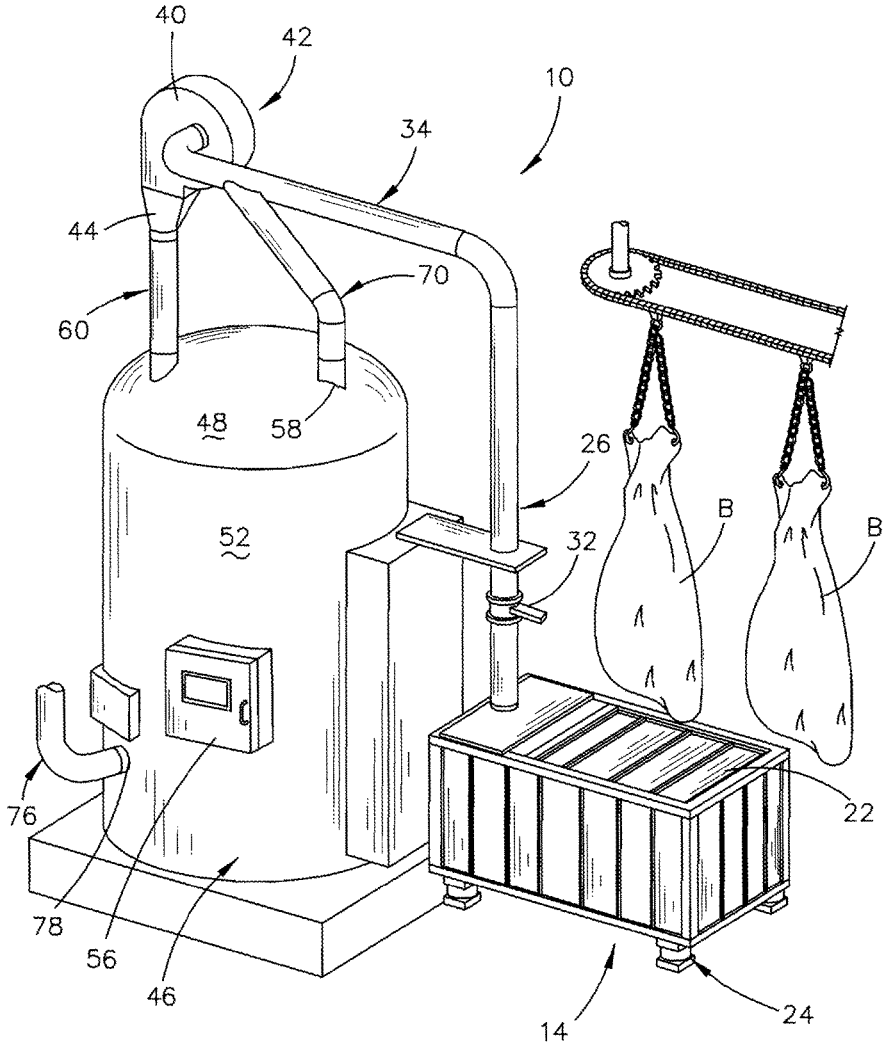
FIG. 3 is a perspective view of the blender of this invention.
Figure 4:
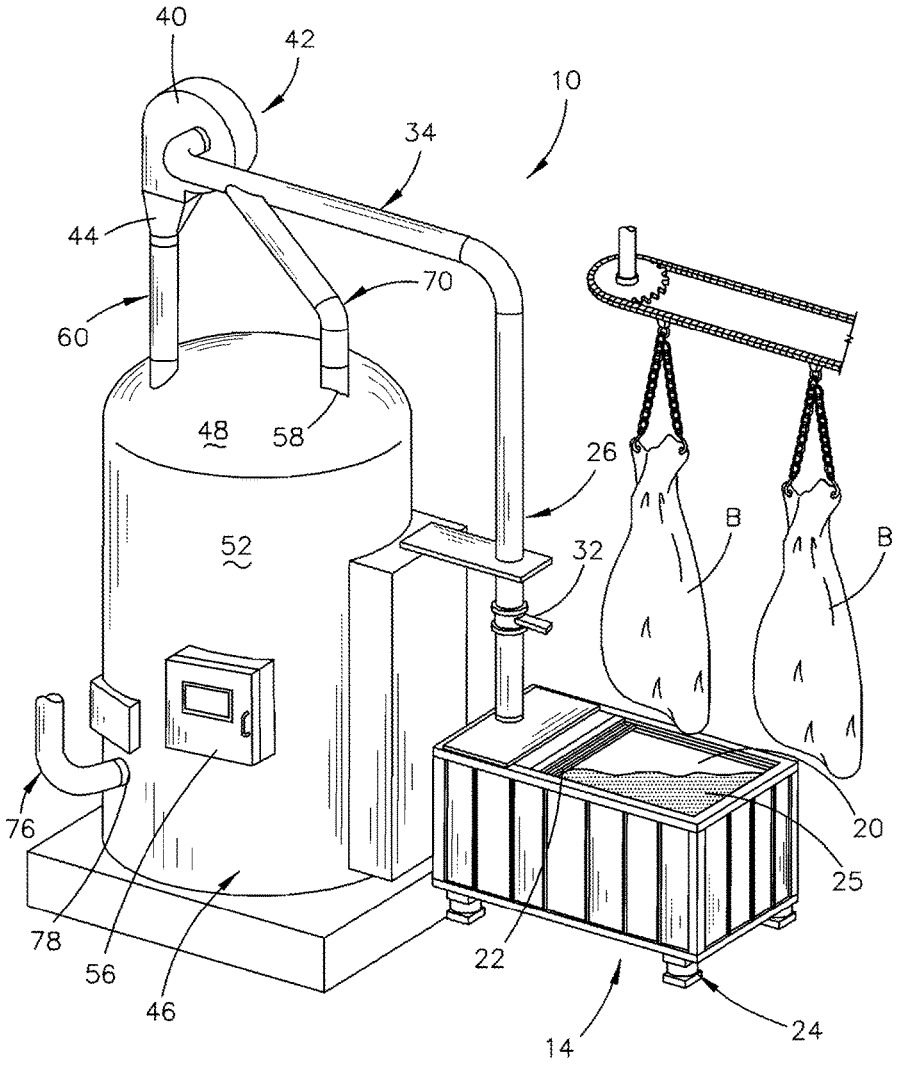
FIG. 4 is a perspective view of the blender of this invention with the cover of the container being opened to permit ingredients to be placed within the container.
Figure 5:
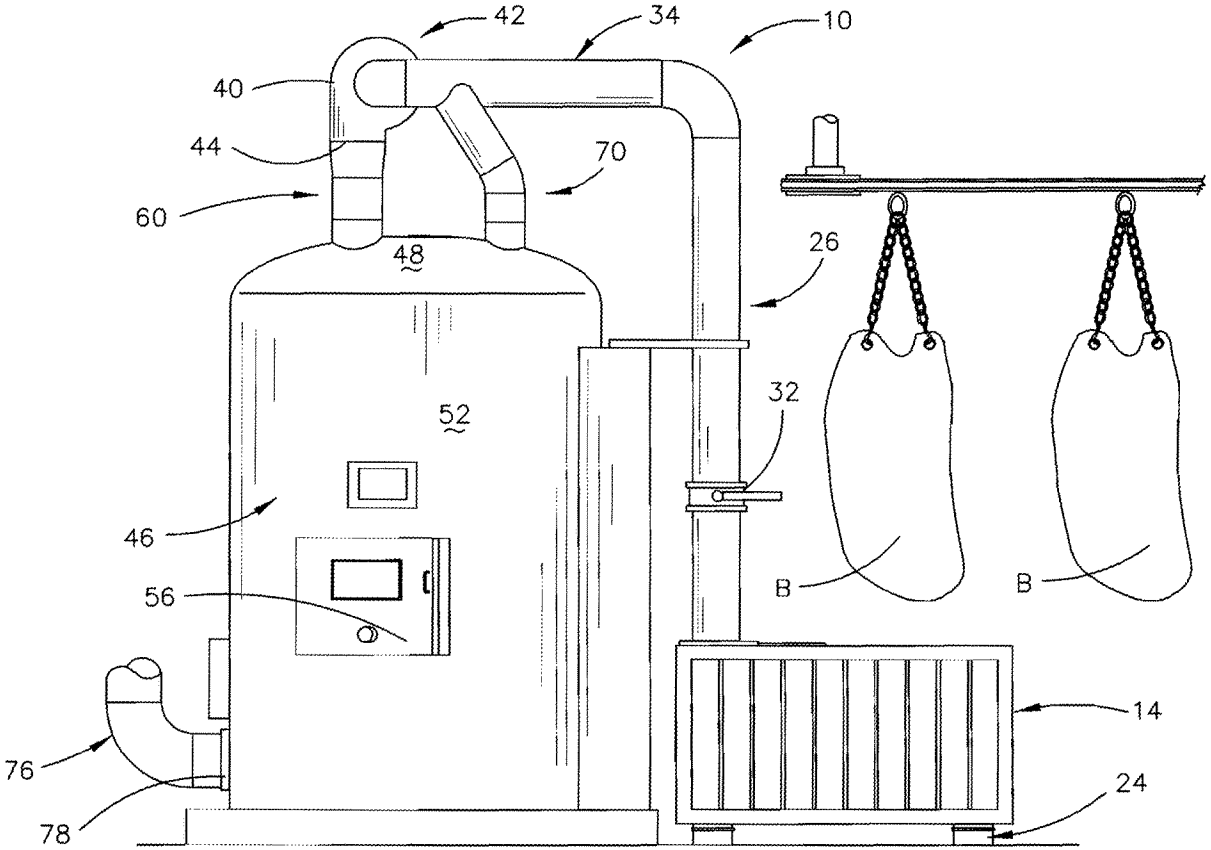
FIG. 5 is a side view of the blender of this invention.
Figure 6:
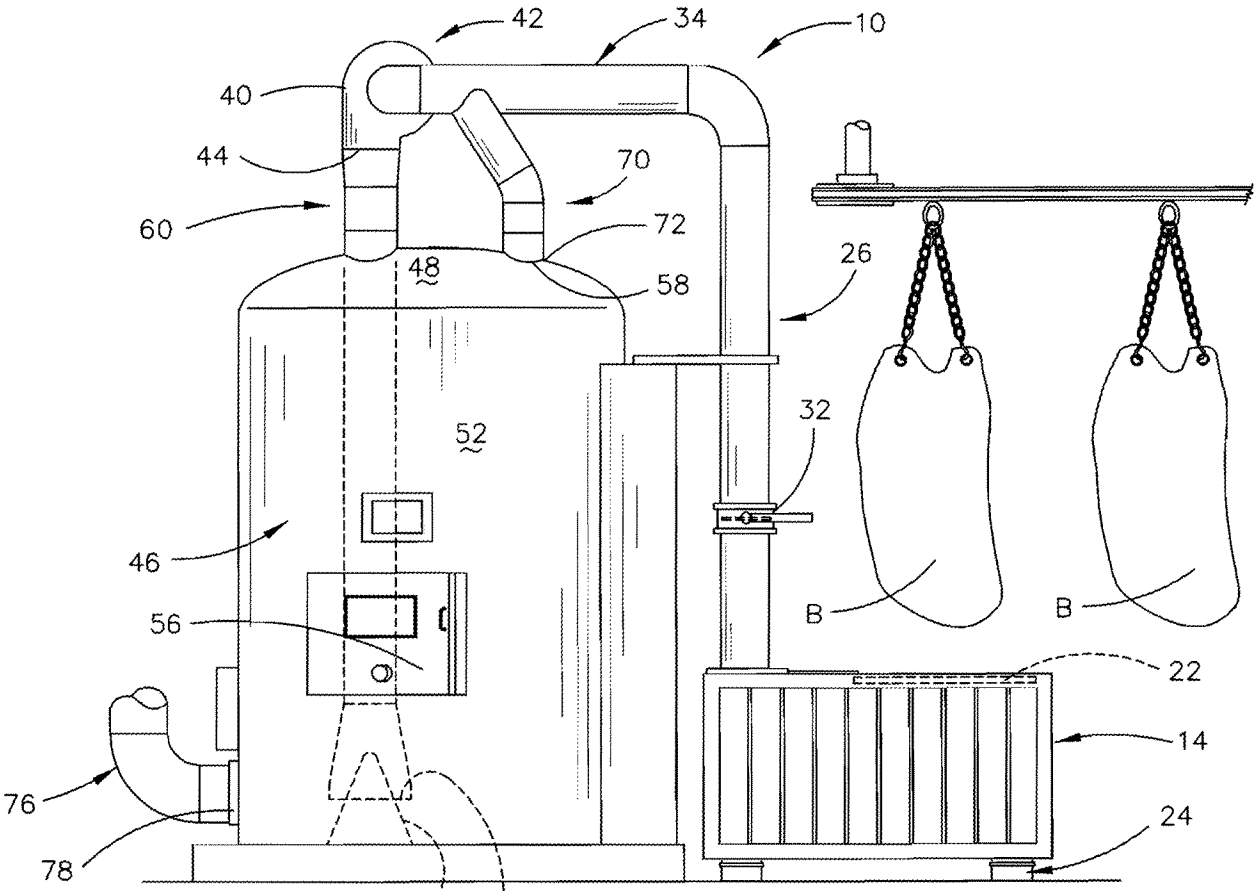
FIG. 6 is a side elevational view of the blender of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to the blender or blender apparatus of this invention which is designed to blend or mix materials or ingredients such as straight milkweed floss fiber and torturous-shaped fiber such as goose down, microrollo and pico. The numeral 12 refers to a bagging unit wherein the final mixture is placed in permeable bags. The bagging unit 12 will be the subject of a separate patent application since the blender 10 may be used with other bagging units.

Blender 10 includes a metal container 14 which has a lower end 16, an upper end 18 and an interior compartment 20. A cover 22 selectively seals the upper end 18 of container 14. The numeral 24 refers to a conventional weighing scale upon which container 14 is positioned. The ingredients or materials 25 to be mixed are weighed and placed in container 14 and the cover 22 is closed. The ingredients 25 to be blended are preferably stored in bags B which are positioned near the container 14 as seen in the drawings.

The numeral 26 refers to a vertically disposed tubular member having an upper end 28 and a lower end 30. Tubular member 26 extends downwardly into container 14 with the lower end 30 being positioned in the ingredients in the container above the lower end 30 of container 14. Tubular member 26 has a first valve or shut gate 32 imposed therein above container 14. Shut gate 32 is selectively movable between open and closed positions. When shut gate 32 is closed, air or ingredients may not pass therethrough. When shut gate 32 is open, air and ingredients may pass therethrough. The numeral 34 refers to an elongated tubular member having a first end 36 and a second end 38. End 36 of tubular member 34 is secured to and is in communication with the upper end 28 of tubular member 26 and extends generally laterally or horizontally therefrom. As will be explained in more detail hereinafter, the second end 38 of tubular member 34 is secured to and is in communication with the intake side 40 of a conventional vacuum motor or vacuum machine 42. Vacuum motor 42 also includes a discharge side 44.

The numeral 46 refers to an upright cylinder having an upper end 48, a bottom or lower end 50, a cylindrical side wall 52 and an interior compartment or blending chamber 54. A small door 56 is provided in cylinder 46 as seen in FIG. 1. When door 56 is opened somewhat, atmospheric air may enter the blending chamber 54 which permits air and mixed ingredients to move freely from the cylinder 46 as will be discussed hereinafter. The upper end 48 of cylinder 46 has an opening 58 formed therein.

The numeral 60 refers to a tubular member having an upper end 62 and a lower end 64. The upper end 62 of tubular member 60 is in communication with the discharge side 44 of vacuum motor 42 and extends therefrom downwardly through an opening 66 formed in the upper end 48 of cylinder 46. The lower end 64 of tubular member 60 is spaced above the bottom 58 of cylinder 46. The numeral 68 refers to an inverted funnel which is attached to the bottom 50 of cylinder 46. The lower end 64 of tubular member 60, inside the outer edge of the funnel 68, is reamed out over the funnel 68 which leaves a consistent space therebetween that forces the air and ingredients being discharged from the lower end 64 of tubular member 60 to deflect the air and ingredients into contact with the side wall 52 of cylinder 46 and blends the mix by rising the air and ingredients towards the upper end of the cylinder 46 as will be described in more detail hereinafter.

The numeral 70 refers to an elongated tubular member having a first end 72 and a second end 74. The first end 72 of tubular member 70 is in communication with the opening 58 formed in the upper end 48 of cylinder 46. The second end 74 of tubular member 70 is in communication with the end 38 of tubular member 34 which is in communication with the intake side 40 of vacuum motor 42.

Figure 7:
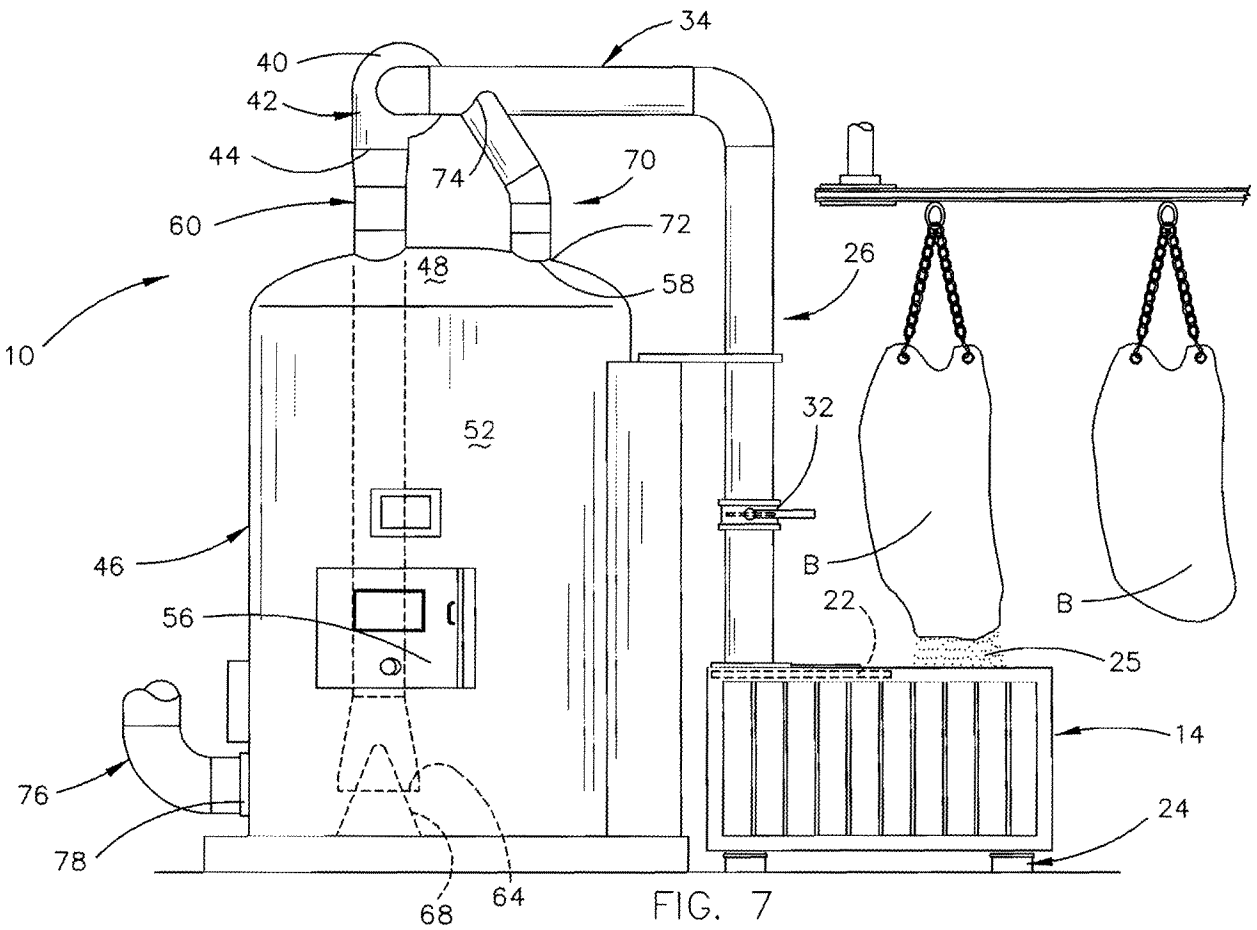
FIG. 7 is a side elevational view of the blender but which illustrates ingredients being dropped into the container of this invention.
Figure 8:
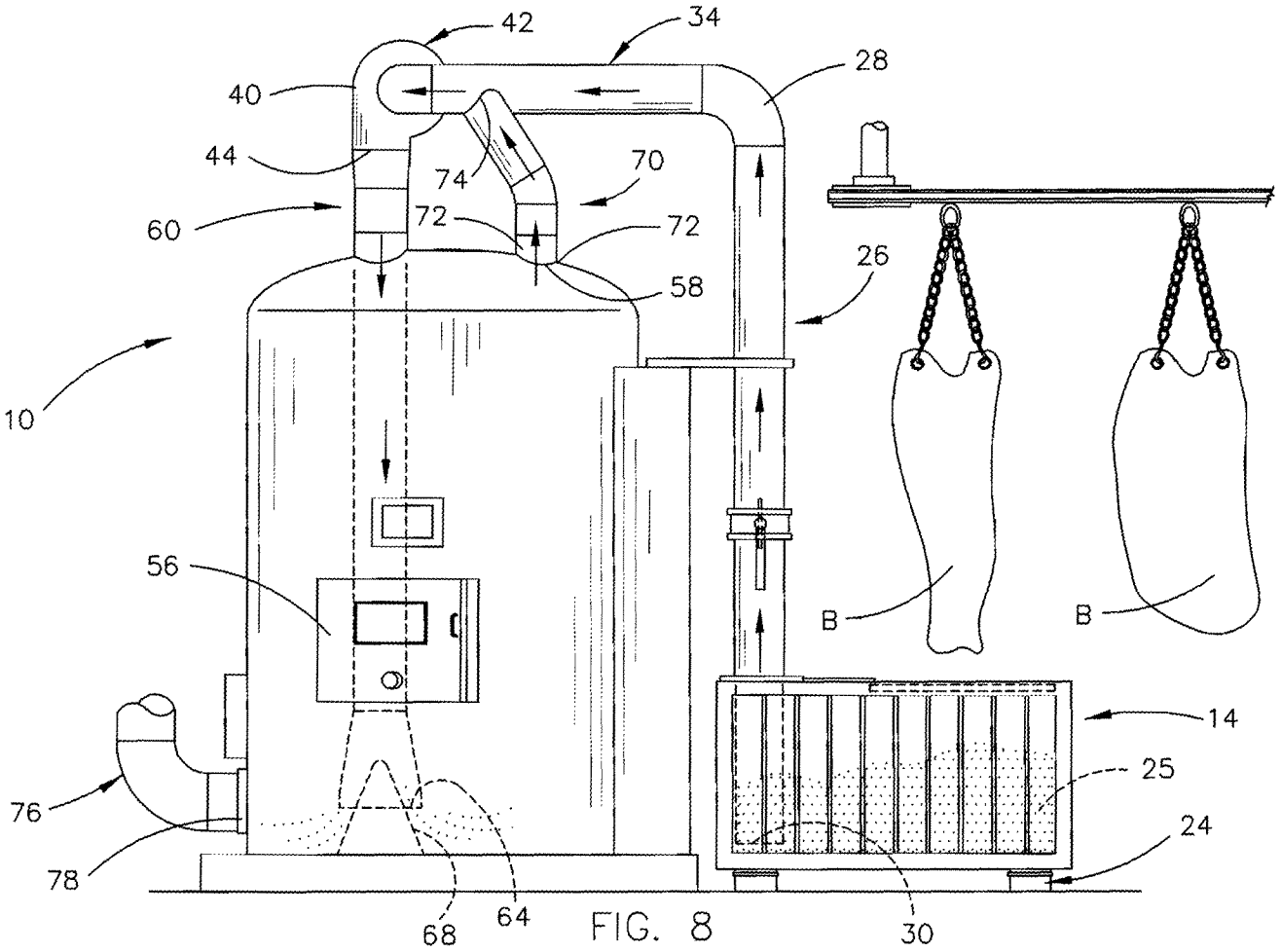
FIG. 8 is a side elevational view similar to FIG. 6 but which illustrates the manner in which the ingredients in the container are supplied to the blending chamber.
Figure 9:
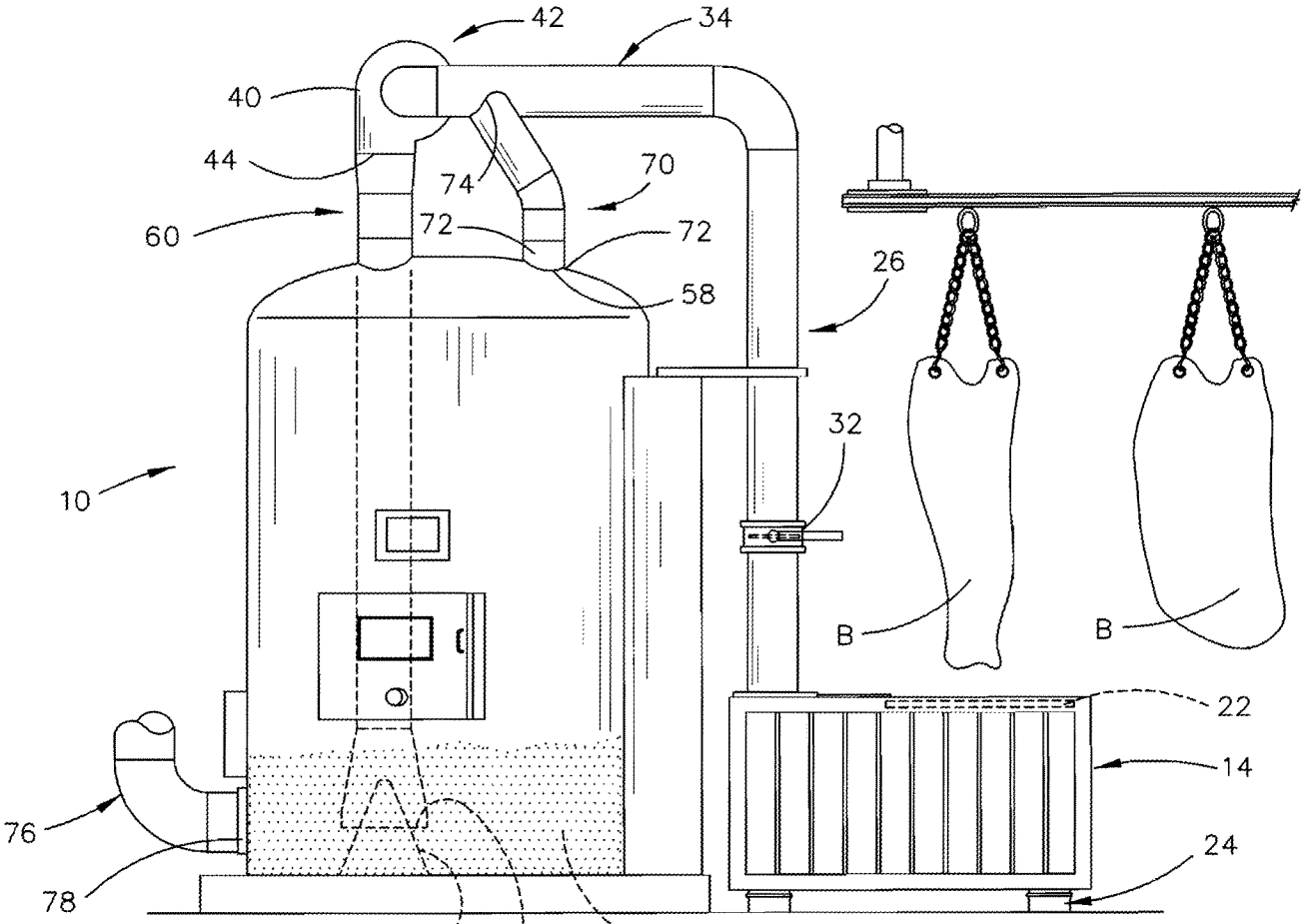
FIG. 9 is a view similar to FIG. 8 but which illustrates the ingredients having been blended.
Figure 10:
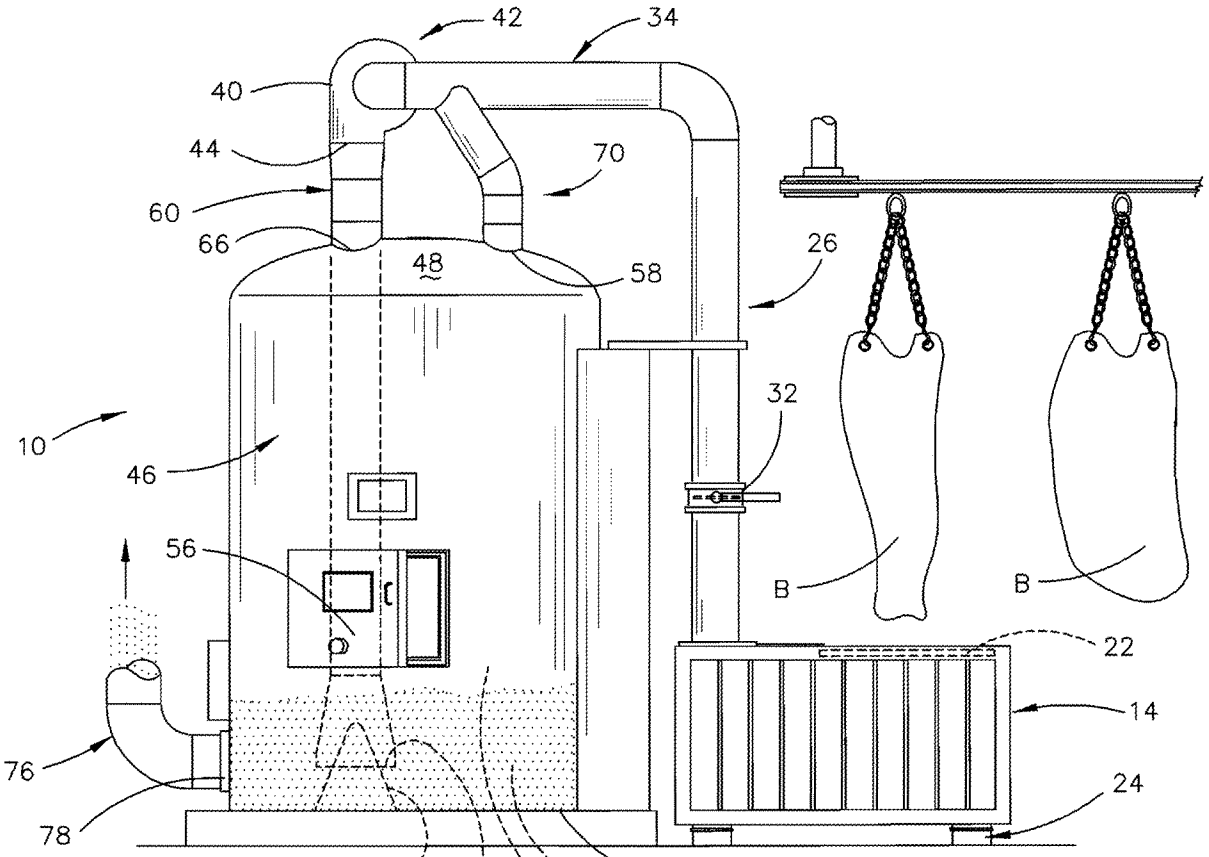
FIG. 10 is a view similar to FIG. 9 except that it is illustrated how the blend is transferred from the blending cylinder.
Figure 11:
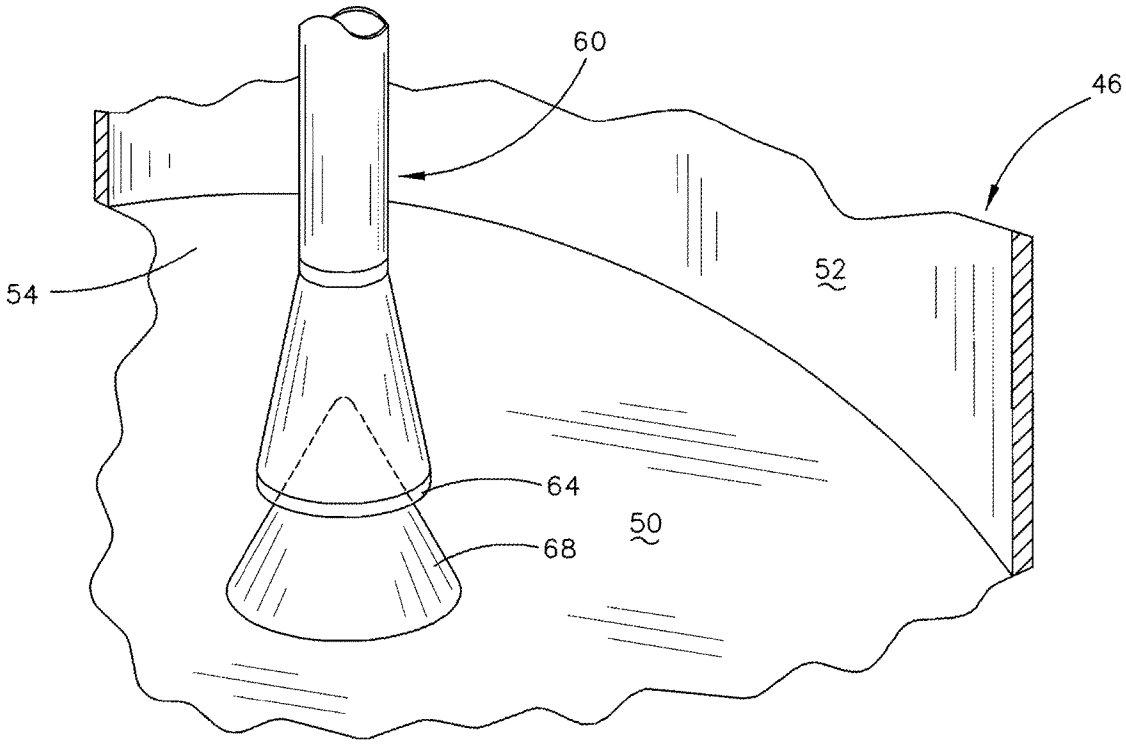
FIG. 11 is a partial perspective view illustrating the lower end of the blending chamber and the lower end of the third tubular member.

The blender 10 functions as will now be described. The vacuum motor 42 is initially deactivated. The cover 22 of container 14 is opened. The various ingredients in bags B are placed in the interior compartment 20 of container 14 (FIG. 7) in weighed amounts as indicated by the weighing scale 24. When the particular ingredients 25 have been added to the container 14 in the desired amounts, the cover 22 is closed. If not already opened, the shut gate or valve 32 is then opened.

The vacuum motor 42 is then actuated. The vacuum motor 42, when actuated, creates a suction in tubular members 34, 26 and 70. At the same time, air is blown from the discharge side 44 of vacuum motor 42 into tubular member 60 and into the blending chamber 54. The suction in tubular members 26 and 34 causes the ingredients 25 in container 14 to be sucked into the lower end 30 of tubular member 26, through tubular member 34 and into the intake side 40 of vacuum motor 42. When the ingredients 25 have been completely drawn from the container 14, the shut gate 32 is closed. The ingredients 25 are blown from the discharge side 44 of vacuum motor 42 into the tubular member 60 and outwardly from the lower end 64 of tubular member 60 with the funnel 68 causing the air and ingredients being discharged from the lower end 64 of tubular member 60 to be forced onto the side wall 52 of cylinder 46 to blend or mix the ingredients 25. The air and ingredients, after striking the side wall 52 of cylinder 46, move upwardly toward the upper inside of cylinder 46 and will be recycled through the opening 58 formed in the upper end of cylinder 46 and through the tubular member 70 and into the intake side 40 of vacuum motor 42. The air and ingredients are discharged from the discharge side 44 of vacuum motor 42 into tubular member 60 and into the blending chamber 54. The recycling is continued until good blending or mixing is achieved. When the ingredients 25 have been blended, the vacuum motor 42 is deactivated. The blended ingredients are then passed to the bagging unit 12 by way of the tubular member 76 which has a valve 78 imposed therein.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A blending apparatus for blending together a plurality of different ingredients, comprising:

a container configured to contain a plurality of different ingredients therein;

said container including a lower end, an upper end, and an interior compartment;

said container including a selectively closeable cover at said upper end thereof;

a hollow blending cylinder having a closed upper end, a closed lower end, a side wall and an interior blending chamber;

said blending chamber being spaced from said container;

said interior blending chamber of said blending cylinder configured to have ingredients therein;

a vacuum motor having an intake side and a discharge side;

an elongated first tubular member having a lower end and an upper end;

said lower end of said first tubular member being positioned in said interior compartment of said container so as to be in communication with the ingredients in said container;

said first tubular member having a first valve imposed therein above said container;

said first valve being selectively movable between open and closed positions;

said first valve, when in said closed position, preventing ingredients from passing therethrough;

said first valve, when in said open position, permitting ingredients to pass therethrough;

said upper end of said first tubular member being in communication with said intake side of said vacuum motor;

said upper end of said cylinder having a first opening formed therein;

a second tubular member having a first end and a second end;

said first end of said second tubular member being in communication with said first opening in said upper end of said cylinder;

said second end of said second tubular member being in communication with said intake side of said vacuum motor;

a third tubular member having a first end and a second end;

said third tubular member extending downwardly through said upper end of said cylinder so that said first end of said third tubular member is positioned at said lower end of said cylinder;

said second end of said third tubular member being in communication with said discharge side of said vacuum motor;

a fourth tubular member having a first end and a second end;

said first end of said fourth tubular member being in communication with said interior compartment of said cylinder;

a second valve imposed in said fourth tubular member;

said second valve being selectively movable between open and closed positions; and said second end of said fourth tubular member being configured to be in communication with a bag filling apparatus.

2. The blending apparatus of claim 1 wherein a deflector is provided at said first end of said third tubular member.

3. The blending apparatus of claim 2 wherein said deflector is configured to deflect materials passing therethrough towards said side wall of said cylinder.

4. The blending apparatus of claim 1 further including a weigh scale and wherein said container is positioned on said weigh scale.

5. A blending apparatus for blending a plurality of different ingredients, comprising:

a weighing scale;

a container configured to contain a plurality of different ingredients therein;

said container having a lower end, an upper end and an interior compartment;

said container including a selectively closeable cover at said upper end thereof;

said container being positioned on said weighing scale;

a vertically disposed and elongated first tubular member having a lower end and an upper end;

said lower end of said first tubular member being positioned in said interior compartment of said container so as to be in communication with the ingredients therein;

said first tubular member extending upwardly from said container;

a first valve positioned in said first tubular member above said container;

said first valve being selectively movable between open and closed positions;

said first valve, when in said closed position, preventing the passage of ingredients therethrough;

said first valve, when in said open position, permitting the passage of ingredients therethrough;

an elongated second tubular member having a first end and a second end;

said first end of said second tubular member being in communication with said upper end of said first tubular member;

said second tubular member extending from said upper end of said first tubular member;

a vertically disposed and hollow blending cylinder having a closed upper end, a closed lower end, a side wall, and a blending chamber;

a vertically disposed and elongated third tubular member having a lower end and an upper end;

said third tubular member extending downwardly through said closed upper end of said cylinder whereby said lower end of said third tubular member is positioned above said lower end of said cylinder and so that said upper end of said third tubular member is positioned above said closed upper end of said cylinder;

a vacuum motor having an intake side and a discharge side;

said upper end of said third tubular member being in communication with said discharge side of said vacuum motor;

said second end of said second tubular member being in communication with said intake side of said vacuum motor;

said closed upper end of said cylinder having an opening formed therein;

a fourth tubular member having a lower end and an upper end;

said lower end of said fourth tubular member being in communication with said opening in said closed upper end of said cylinder;

a fifth tubular member having a first end and a second end;

said first end of said fifth tubular member being in communication with said upper end of said fourth tubular member;

said second end of said fifth tubular member being in communication with said intake side of said vacuum motor;

a sixth tubular member having a first end and a second end;

said first end of said sixth tubular member being in communication with said bagging chamber of said cylinder; and said blending chamber being in selective communication with a blended ingredient collection apparatus.

6. The blending apparatus of claim 5 wherein a deflector is provided at said lower end of said third tubular member.

* * * * *